US011898831B2

(12) United States Patent
Mouret et al.

(10) Patent No.: US 11,898,831 B2
(45) Date of Patent: Feb. 13, 2024

(54) METHOD AND SYSTEM FOR CREATING MARKS ON BULLETS

(71) Applicant: ULTRA ELECTRONICS FORENSIC TECHNOLOGY INC., St-Laurent (CA)

(72) Inventors: Nicolas Mouret, Verdun (CA); Valentin Dulhariu, Laval (CA); Paul J. Murphy, Virginia Beach, VA (US)

(73) Assignee: ULTRA ELECTRONICS FORENSIC TECHNOLOGY INC., Montreal (CA)

( * ) Notice: Subject to any disclaimer, the term of this patent is extended or adjusted under 35 U.S.C. 154(b) by 0 days.

(21) Appl. No.: 17/995,498

(22) PCT Filed: Apr. 22, 2021

(86) PCT No.: PCT/CA2021/050552

§ 371 (c)(1),
(2) Date: Oct. 5, 2022

(87) PCT Pub. No.: WO2021/212228

PCT Pub. Date: Oct. 28, 2021

(65) Prior Publication Data

US 2023/0175824 A1 Jun. 8, 2023

Related U.S. Application Data

(60) Provisional application No. 63/163,272, filed on Mar. 19, 2021, provisional application No. 63/014,362, filed on Apr. 23, 2020.

(51) Int. Cl.
*F42B 35/00* (2006.01)
*F42B 5/02* (2006.01)

(52) U.S. Cl.
CPC ..... *F42B 35/00* (2013.01); *F42B 5/025* (2013.01)

(58) Field of Classification Search
CPC ..... F41A 31/02; F41A 31/00; F41A 99/00; F41C 27/00; F42B 35/00
USPC ..... 42/95, 106, 90; 73/167
See application file for complete search history.

(56) References Cited

U.S. PATENT DOCUMENTS 1,665,988 A * 4/1928 Smith ..... F41A 29/02 15/104.165
4,928,523 A 5/1990 Muhrer et al.
5,016,380 A * 5/1991 Jones ..... F41A 29/02 81/177.4

(Continued)

*Primary Examiner* — Jonathan C Weber
(74) *Attorney, Agent, or Firm* — Norton Rose Fulbright Canada LLP

(57) ABSTRACT

A bullet compressing device for creating marks imparted by a barrel of a gun on a bullet, has: a first member; a second member spaced from the first member by a gap, a dimension of the gap selected to correspond to at least a length of the bullet, the first and second members slidingly receivable within the barrel of the gun; a biasing member in engagement with the first and second members, the biasing member having a compressed configuration in which the first and second members are biased toward one another thereby decreasing the dimension of the gap, one of the first and second members engageable by an actuator, the first and second members and the bullet received therebetween movable relative to the barrel thereby imparting marks on the bullet by the barrel upon actuation of the actuator.

20 Claims, 11 Drawing Sheets

(56) References Cited

U.S. PATENT DOCUMENTS

| | | | | | |
|---|---|---|---|---|---|
| 5,446,987 | A * | 9/1995 | Lee | F41C 9/085 | 42/61 |
| 5,836,099 | A * | 11/1998 | Pace | F41A 29/02 | 42/95 |
| 6,018,394 | A | 1/2000 | Baldur | | |
| 7,686,359 | B1 * | 3/2010 | Walker | B25B 27/00 | 411/401 |
| 2022/0214151 | A1 | 7/2022 | Bonin et al. | | |

* cited by examiner

METHOD AND SYSTEM FOR CREATING MARKS ON BULLETS

CROSS-REFERENCE TO RELATED APPLICATIONS

This application claims priority from U.S. patent application 63/014,362 filed on Apr. 23, 2020 and U.S. patent application 63/163,272 filed on Mar. 19, 2021. Their contents are incorporated herein in their entirety.

TECHNICAL FIELD

This disclosure generally relates to the field of forensic science and, more particularly, to systems and methods used to create gun barrel marks on bullets.

BACKGROUND OF THE ART

When firing a firearm, its barrel imparts distinctive marks on the bullets. These marks may be gun specific, similar to fingerprints for humans. Comparing those marks may allow law enforcement officers to associate a crime with a particular gun. To determine whether or not a bullet has been fired using a particular firearm, another bullet is fired and the marks on both bullets are compared. While this technique may be suitable in some circumstances, there is room for improvement.

SUMMARY

In one aspect, there is provided, a device for creating marks imparted by a barrel of a gun on a bullet, comprising: a first member and a second member spaced from the first member by a gap, a dimension of the gap selected to correspond to a length of the bullet, the first and second members slidingly receivable within the barrel of the gun; a biasing member in engagement with the first and second members, the biasing member having a compressing configuration in which the first and second members are biased toward one another thereby decreasing the dimension of the gap, one of the first and second members engageable by an actuator, the first and second members and the bullet received therebetween movable relative to the barrel thereby imparting marks on the bullet by the barrel upon actuation of the actuator.

In some embodiments, the first member is a head of a first bolt or a bulge located at an end of a cable, and wherein the second member is a tube disposed around a shank of the first bolt, the gap defined between an end of the tube and the head of the first bolt.

In some embodiments, an external diameter of the tube is less than an internal diameter of the barrel.

In some embodiments, the shank of the first bolt is slidingly receivable within an aperture defined through the bullet.

In some embodiments, a diameter of the head of the first bolt is greater than a diameter of the aperture through the bullet.

In some embodiments, the biasing member is a spring.

In some embodiments, the other end of the tube is in engagement with the biasing member.

In some embodiments, the biasing member is disposed between the tube and a plate, the biasing member exerting a force in a direction parallel to the shank of the first bolt to increase a distance between the plate and the tube.

In some embodiments, a variable-length member is located between the plate and the other end of the tube, the variable-length member operable to vary a length of the biasing member to vary a force exerted by the biasing member to bias the first and second members toward one another.

In some embodiments, the biasing member is a coil spring, the variable-length member being surrounded by the coil spring.

In some embodiments, the variable-length member includes an elongated nut threadingly engaging the shank of the first bolt, rotation of the elongated nut relative to the shank of the first bolt varying an effective length of the shank and varying a distance between the plate and the tube.

In some embodiments, one of the first and second members is in engagement with the bullet via a sacrificial sleeve, the sacrificial sleeve being compressed by the biasing member and configured to break upon the sacrificial sleeve exiting the barrel to decrease a compression force exerted by the biasing member on the bullet.

In some embodiments, the bullet disposed between a guiding member and the sacrificial sleeve, the guiding member in contact against the barrel.

In some embodiments, the guiding member is made of a material having a hardness less than that of the barrel.

In some embodiments, the guiding member is made of copper.

In another aspect, there is provided a device for creating marks imparted by a barrel of a gun on a bullet, comprising: compressing means for engaging opposite ends of the bullet and for compressing the bullet in an axial direction relative to a central axis of the barrel.

In yet another aspect, there is provided a method of creating marks imparted by a barrel of a gun on a bullet, comprising: inserting the bullet within the barrel; deforming the bullet in a radial direction relative to a central axis of the barrel; and dragging the deformed bullet in an axial direction along the barrel thereby imparting marks on the bullet.

In some embodiments, inserting the bullet within the barrel includes disposing the bullet between first and second members.

In some embodiments, deforming the bullet includes compressing the bullet in the axial direction by decreasing a distance between the first and second members.

In some embodiments, deforming the bullet includes decreasing a length of a biasing member.

In some embodiments, a compression force exerted the bullet is removed before the bullet is removed from the barrel.

In some embodiments, the first member is a head of a bolt, the method including creating an aperture through the bullet and inserting a shank of the bolt within the aperture.

In some embodiments, compressing the bullet includes compressing a spring by decreasing an effective length of the shank thereby increasing a tension force exerted on the shank of the bolt.

In some embodiments, the deforming of the bullet is done before the inserting of the bullet within the barrel.

In some embodiments, the deforming of the bullet includes subjecting the bullet to a deceleration.

In still another aspect, there is provided a cold firing apparatus for creating barrel marks on a bullet with a barrel of a firearm, comprising: a frame; a holding device secured to the frame and operable to hold the firearm; a compressing device operable to compress the bullet while the bullet is inside the barrel; and a pulling device engaged to the compressing device, the pulling device operable to pull on the compressing device to pull the bullet along the barrel of the firearm.

In some embodiments, the compressing device has a housing defining an inner cavity, a biasing member received into the inner cavity and engaged to the housing, a first member and a second member both engaged by the biasing member for biasing the first member toward the second member and both receivable within the barrel, the bullet receivable between the first member and the second member.

In some embodiments, the first member is a tube and wherein the second member is a bulge secured to an end of a cable, the tube extending around the cable.

In some embodiments, the compressing device has a cable holding device received in the inner cavity and operable for securing the cable relative to the housing, and a tensioning device operable for imparting a tension in the cable for compressing the bullet between the bulge and the tube.

In some embodiments, the tensioning device has a cam rollingly engaged to the housing and a cam follower engaged by the cam, the cam follower engaged to the cable via the cable holding device, rotation of the cam pushing on the cam follower and pushing on the cable holding device thereby pulling on the cable and compressing the biasing member.

In some embodiments, a pusher-guide is received in the inner cavity, the cable extending through the pusher-guide, the pusher-guide having a pusher in abutment against the biasing member and a guide extending from the pusher, the biasing member located between the pusher and a shoulder defined by the housing, the biasing member extending around the guide.

In some embodiments, the holding device has clamps and wherein the pulling device is a winch.

In some embodiments, a plate is rollingly engaged to the frame, the plate defining apertures of varying sizes to accept respective ends of barrels of varying caliber.

In still another aspect, there is provided a bullet compressing device for creating marks imparted by a barrel of a gun on a bullet, comprising: a first member; a second member spaced from the first member by a gap, a dimension of the gap selected to correspond to at least a length of the bullet, the first and second members slidingly receivable within the barrel of the gun; a biasing member in engagement with the first and second members, the biasing member having a compressed configuration in which the first and second members are biased toward one another thereby decreasing the dimension of the gap, one of the first and second members engageable by an actuator, the first and second members and the bullet received therebetween movable relative to the barrel thereby imparting marks on the bullet by the barrel upon actuation of the actuator.

In some embodiments, the first member is a head of a first bolt or a bulge located at an end of a cable, and wherein the second member is a tube disposed around a shank of the first bolt or around the cable, the gap defined between an end of the tube and the head of the first bolt or the bulge of the cable.

In some embodiments, a housing defines an inner cavity, the biasing member received into the inner cavity and engaged to the housing.

In some embodiments, a cable holding device is received in the inner cavity and operable for securing the cable relative to the housing, and a tensioning device operable for imparting a tension in the cable for compressing the bullet between the bulge and the tube.

In some embodiments, the tensioning device has a cam rollingly engaged to the housing and a cam follower engaged by the cam, the cam follower engaged to the cable via the cable holding device, rotation of the cam pushing on the cam follower and pushing on the cable holding device thereby pulling on the cable and compressing the biasing member.

In some embodiments, a pusher and a guide are both received in the inner cavity, the cable extending through the pusher, the pusher being in abutment against the biasing member, the guide partially received within a bore defined by the pusher, the biasing member located between the pusher and a shoulder defined by the housing, the biasing member extending around the guide.

In some embodiments, the device includes a release lever rotatable relative to the housing, the release lever having a cam portion engageable to the guide, rotation of the release lever pushes on the guide thereby pushing on jaws of the cable holding device to free the cable from the jaws.

In some embodiments, the biasing member is a spring.

In some embodiments, one of the first and second members is in engagement with the bullet via a sacrificial sleeve, the sacrificial sleeve being compressed by the biasing member and configured to break upon the sacrificial sleeve exiting the barrel to decrease a compression force exerted by the biasing member on the bullet.

In some embodiments, the device includes a guiding member, the bullet disposed between the guiding member and the sacrificial sleeve, the guiding member in contact against the barrel.

In some embodiments, the guiding member is made of a material having a hardness less than that of the barrel.

In some embodiments, the guiding member is made of copper.

In still another aspect, there is provided a method of creating marks imparted by a barrel of a gun on a bullet, comprising: inserting the bullet within the barrel; deforming the bullet in a radial direction relative to a central axis of the barrel; and dragging the deformed bullet in an axial direction along the barrel thereby imparting marks on the bullet.

In some embodiments, the deforming of the bullet includes compressing the bullet in the axial direction.

In some embodiments, the compressing of the bullet includes compressing the bullet in the axial direction by decreasing a length of a biasing member.

In some embodiments, the method includes guiding the bullet with a guiding member at least until the bullet is completely out of the barrel.

In still another aspect, there is provided a cold firing apparatus for creating barrel marks on a bullet with a barrel of a firearm, comprising: a frame; a holding device secured to the frame and operable to hold the firearm; a compressing device operable to compress the bullet while the bullet is inside the barrel; and a pulling device engaged to the compressing device and secured to the frame, the pulling device operable to pull on the compressing device to pull the bullet along the barrel of the firearm.

In some embodiments, the compressing device includes a biasing member, a first member and a second member both engaged by the biasing member for biasing the first member toward the second member, the first member and the second member both receivable within the barrel, the bullet receivable between the first member and the second member.

In some embodiments, the compressing device has a cable holding device operable for securing the cable relative to a housing of the compressing device, and a tensioning device operable for imparting a tension in the cable for compressing the biasing member and for compressing the bullet between the first member and the second member.

In some embodiments, a plate is rollingly engaged to the frame, the plate defining apertures of varying sizes to accept respective ends of barrels of varying caliber.

It will be appreciated that the compressing device and cold firing apparatus may include any of the features described above, in any combinations.

Many further features and combinations thereof concerning the present improvements will appear to those skilled in the art following a reading of the instant disclosure.

DETAILED DESCRIPTION

Figure 1:
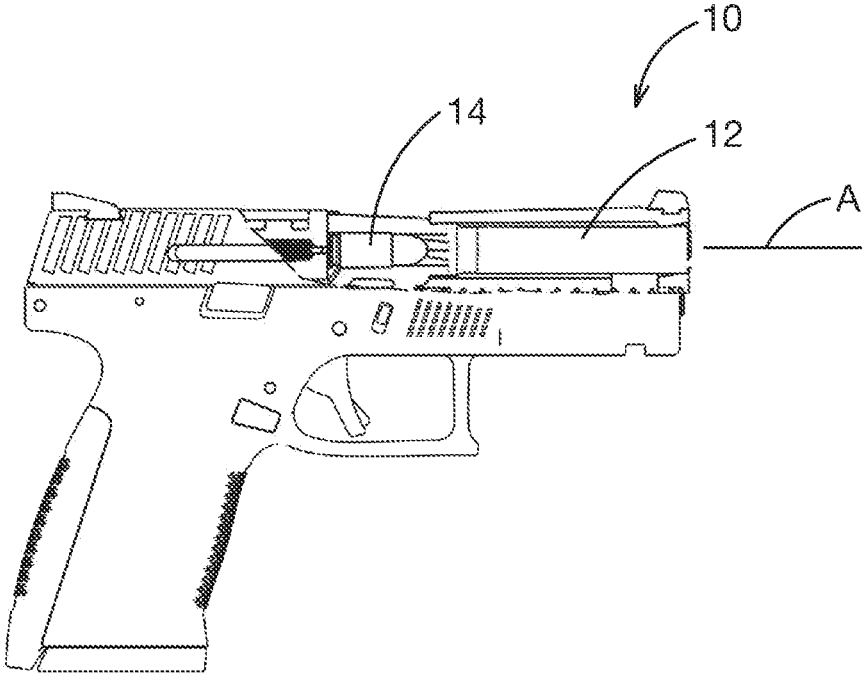
FIG. 1 is a schematic side partially cutaway view of a handgun in accordance with one embodiment.

Referring to FIG. 1, a firearm, such as a handgun in accordance with one embodiment, is shown at 10. The firearm 10 has a barrel 12 via which a bullet 14 is ejected. The barrel 12 may leave distinctive marks on the bullet 14. This may be the results of manufacturing tolerances making each barrel unique. In forensic science, the marks on the bullet 14 may be analyzed to determine if a given firearm has fired a bullet found in a crime scene. One way of doing this analysis is by firing the firearm 10 and comparing the marks obtained on the fired bullet and on the bullet found at the crime scene. If the marks correspond, then the firearm 10 has fired the bullet and was used at the crime scene. However, such an analysis may be dangerous as it requires firing the firearm.

Another way of doing this analysis may be to manually push the bullet through the barrel 12 of the firearm 10 and compare the marks afterwards. However, it has been observed that such a comparison may be inaccurate because effects of the explosion propelling the bullet 14 out of the barrel 12 may not be factored in. More specifically, it has been observed that the marks imparted by the barrel 12 on the bullet 14 vary as a function of the acceleration of the bullet 14 within the barrel 12. In other words, manually pushing the bullet 14 through the barrel 12 will impart different marks on the bullet 14 than actually firing the firearm 10. This difference results from a compression force imparted by the explosion on the bullet 14. The compression force deforms the bullet 14 in a radial direction relative to a central axis A of the barrel 12 and pushes the bullet 14 against a peripheral wall of the barrel 12.

In other words, speed and acceleration of the bullet 14 within the barrel 12 may alter the marks left by the barrel 12 on the bullet 14. In a particular embodiment, an average acceleration of the bullet 14 within the barrel 12 is about 65*10^3 G. The bullet 14 may therefore be subjected to a force greater than about 6000 Newton. This force may induce a compressive force on the bullet 14 that gradually decreases from a base of the bullet 14 to a tip thereof in function of its mass distribution along the central axis A of the barrel 12. This compressive force may cause the bullet 14 to expand radially outwardly relative to the central axis A and to increase in diameter. An interaction force between the bullet 14 and the barrel 12 is therefore affected by the compressive force exerted by the explosion on the bullet 14. Thus, the marks imparted on the bullet 14 by the barrel 12 vary in function of this compressive force.

Figure 2:
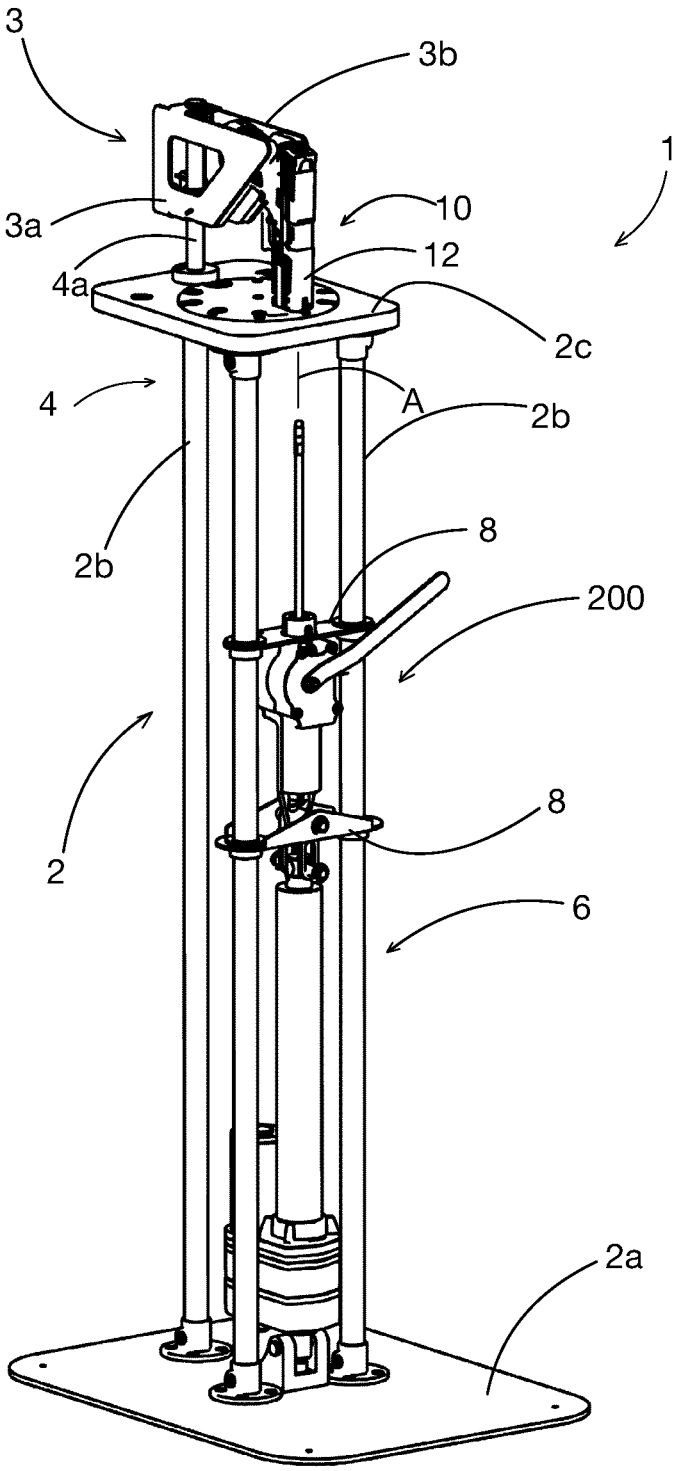
FIG. 2 is a three dimensional view of a cold firing apparatus in accordance with one embodiment for creating marks on a bullet.

Referring now to FIG. 2, a cold firing apparatus is shown at 1. The cold firing apparatus 1 may allow cold firing the firearm 10 without having to dismantle the firearm 10 to remove its barrel 12 (FIG. 1). Dismantling a firearm requires expertise. The disclosed cold firing apparatus 1 may allow personnel not qualified to dismantle a firearm to use the cold firing apparatus 1 for the purpose of creating marks on a bullet 14.

The cold firing apparatus 1 includes a frame 2, which may be referred to as an enclosure, and a holding device 3 connected to the frame 2. The frame 2 has a base 2*a*, which may act as an interface with a ground or a table top. The frame 2 has frame members 2*b* extending from the base 2*a* in a generally vertical direction. Three frame members 2*b* are shown but more or less is contemplated. Also, the frame 2 may alternatively include sidewalls protruding from the base. The frame 2 has a top plate 2*c*. The frame members 2*b* extend from the base 2*a* to the top plate 2*c*. The holding device 3 is used to firmly hold the firearm 10 during a cold firing process. The holding device 3 includes a clamp 3*a* and pads 3*b*. The pads 3*b* may be made of a soft material (e.g., rubber) and act as an interface between the clamp 3*a* and the firearm 10. The pads 3*b* may be shaped as a trapezoid or may be L-shaped. The pads 3*b* are designed for holding small firearms (e.g., pistols) by the grip and for holding longer firearms (e.g. rifle) by the stock or by any other safe part. The holding device 3 may include a biasing member such as a spring for biasing the clamp 3*a* in a closed position and for biasing the pads 3*b* toward one another against the firearm 10. Any other suitable holding device may be used without departing from the scope of the present disclosure. For instance, the firearm may be bolted to the frame.

In the embodiment shown, the holding device 3 is secured to the frame 2 via a sliding mechanism 4 for adjusting a height of the holding device 3 relative to the frame 2 for holding firearms of different lengths (e.g. pistol vs. rifle). In the disclosed embodiment, the sliding mechanism 4 includes a rod 4*a* that is received into a correspondingly sized aperture defined through the top plate 2*c* of the frame 2. A locking mechanism, such as a screw, may be used to secure the rod 4*a* at its desired height from the frame 2. The rod 4*a* may be received into one of the frame members 2*b* of the frame 2, but other configurations are contemplated without departing from the scope of the present disclosure.

The cold firing apparatus 1 includes a compressing device 200 that is described further below. It will be appreciated that the cold firing apparatus 1 may be used with any of the compressing devices 100, 200 described above with reference to FIGS. 4-5 and 8-10. The cold firing apparatus 1 includes a pulling device 6 depicted as a linear actuator and operable to pull the compressing device 200 downwardly for pulling a bullet within the barrel 12 of the firearm 10. The pulling device 6 may alternatively be a winch coupled to a cable; an end of the cable attached to the compressing device 200. Any other suitable pulling means may be used without departing from the scope of the present disclosure. For instance, the pulling device 6 may include levers, dropped weights, hydraulic actuators, pneumatic actuators, lead screws, pulleys, solenoid, rack and pinion gears, linear actuators, and so on.

As shown in FIG. 2, the compressing device 200 is attached to two carriers 8. Each of the two carriers 8 is slidably engaging two of the frame members 2*b*. In the present case, the two carriers 8 are plates having apertures sized to accept the frame members 2*b*. Bearings may be used between the carriers 8 and the frame members 2*b* for easing movement of the compressing device 200 along the frame members 2*b*. These carriers 8 may allow to maintain the compressing device 200 centered relative to the central axis A during the cold firing process.

Figure 3:
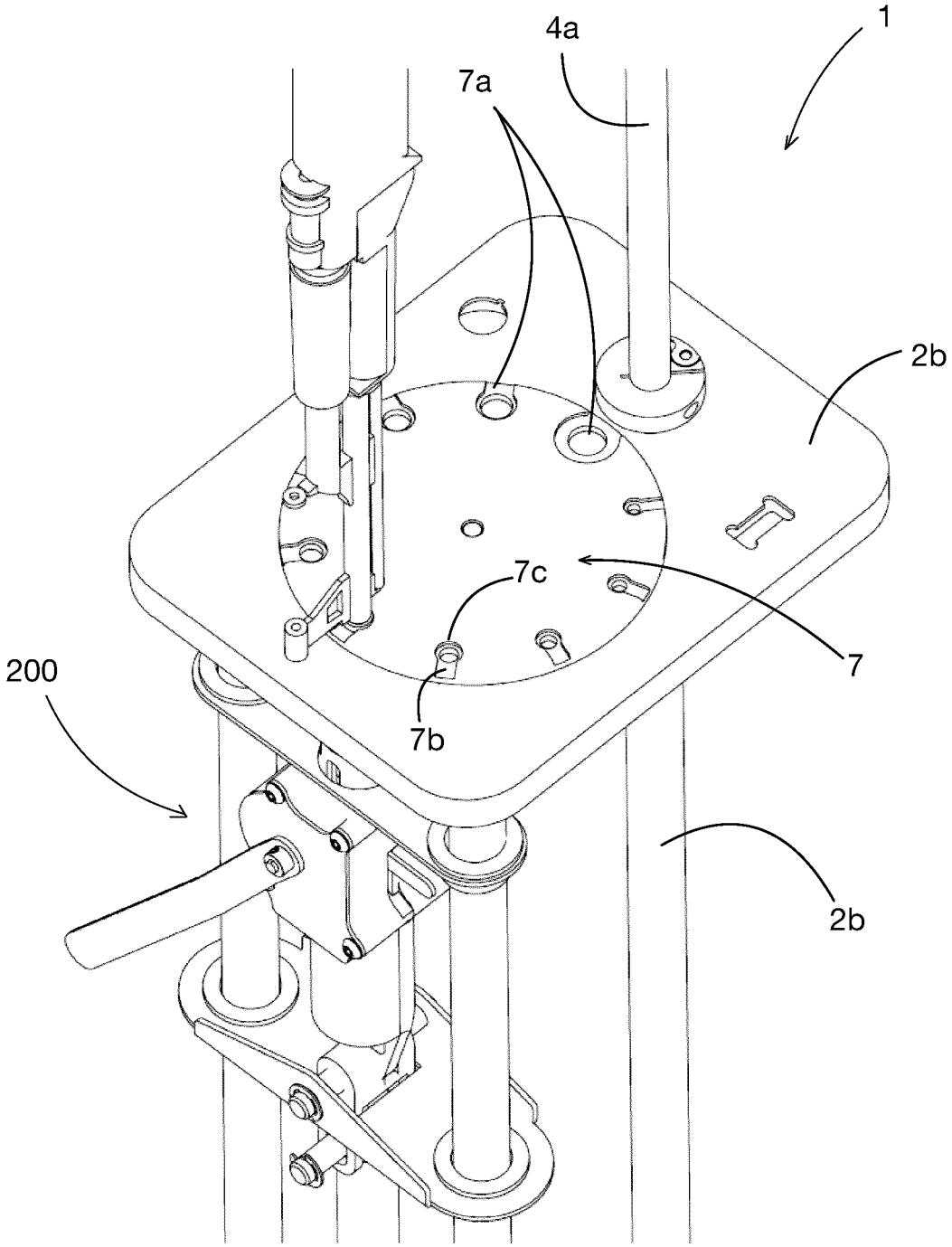
FIG. 3 is a top three dimensional view of the cold firing apparatus of FIG. 2.

Referring now to FIG. 3, a rotatable plate 7 is mounted on the top plate 2*b* of the frame 2. In the embodiment shown, the rotatable plate 7 is rotatable relative to the frame 2 and defines apertures 7*a* of varying shapes and diameters to accept different types of barrels without damaging a front sight or any other part of said barrels. For aligning the barrel 12 with the cold firing apparatus 1, an end of the barrel 12 is placed in the tightest aperture in which the barrel 12 can fit freely. By rotating the rotatable plate 7, the selected aperture is placed in register with an aperture defined through the frame 2 for proper alignment of the compressing device 200 in relation to the barrel 12. In the embodiment shown, each of those apertures 7*a* is surrounded by a shoulder 7*b* and a peripheral wall 7*c*. The shoulder 7*b* is in abutment against the end of the barrel 12 to prevent the barrel from penetrating through the top plate 2*b* of the frame 2. The peripheral wall 7*c* extends around the shoulder 7*b* and is generally transverse to the shoulder 7*b* and is used to stabilize the barrel 12. In other words, the peripheral wall 7*c* may limit the barrel 12 from slipping from left to right or from front to back. It will be appreciated that other configurations are contemplated without departing of the scope of the present disclosure. For instance, common plungers systems can ensure an accurate position of the hole. The common plungers may include any mechanism having a ball biased into a recess or cavity.

Figure 4:
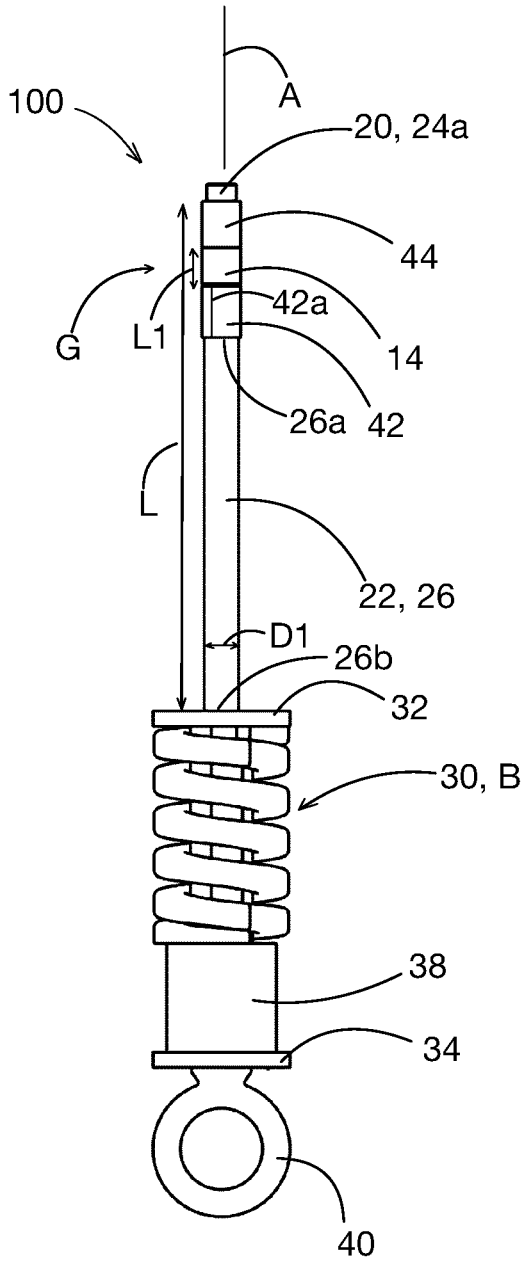
FIG. 4 is a side view of a compressing device used for creating marks on a bullet in accordance with one embodiment and which may be used with the cold firing apparatus of FIG. 2.
Figure 5:
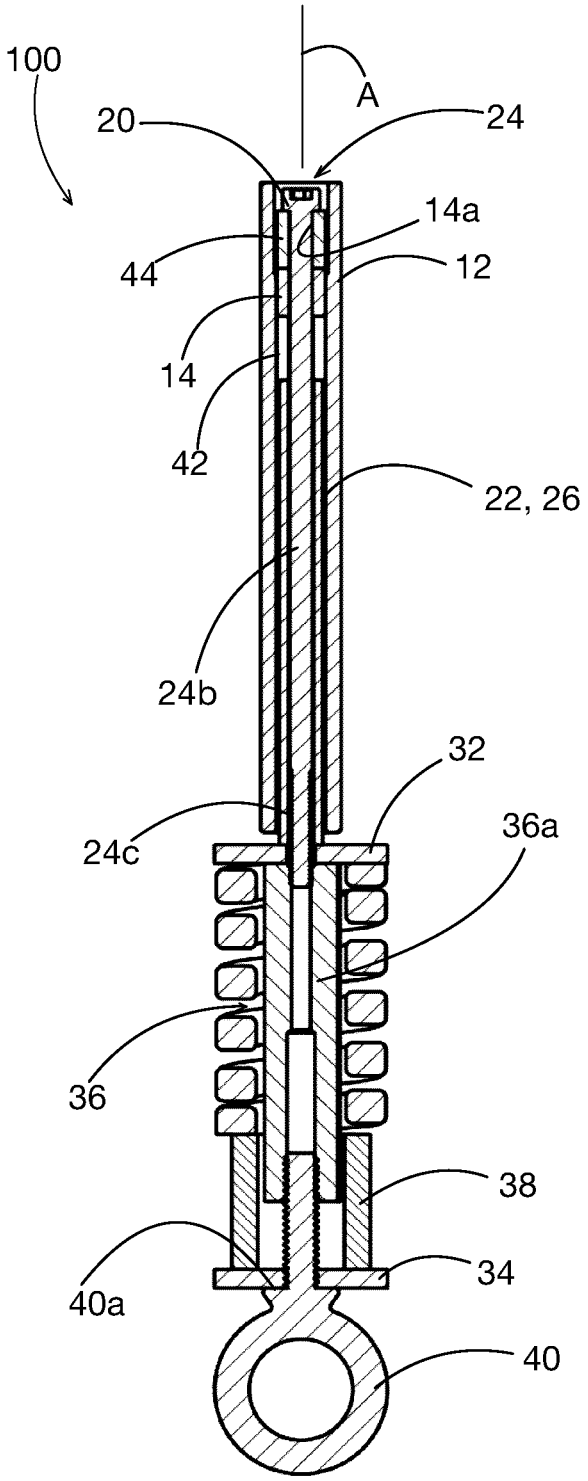
FIG. 5 is a cutaway view of the compressing device of FIG. 4.

Referring now to FIGS. 4-5, a device that may allow simulating the compressive force on the bullet 14 without firing the firearm 10 is shown generally at 100. The compressing device 100 includes first member 20 and the second member 22 that are spaced apart from one another by a gap G. The bullet 14 is received within the gap G between the first member 20 and the second member 22. In other words, a dimension of the gap G may be selected to correspond substantially to a length L1 of the bullet 14; the length L1 taken in an axial direction relative to the central axis A. In the embodiment shown, the first member 20 corresponds to a head 24*a* of a bolt 24 whereas the second member 22 corresponds to a tube 26 that is disposed around a shank 24*b* of the bolt 24. The shank 24*b* of the bolt 24 may extend through an aperture 14*a* defined through the bullet 14. A washer may be disposed between the head 24*a* of the bolt 24 and the bullet 14 and disposed around the shank 24*b* of the bolt 24. The washer may assist in distributing pressure on the bullet 14, but may be omitted in some embodiments.

A diameter D1 of the tube 26 is less than an internal diameter of the barrel 12. A diameter of the head 24*a* of the bolt 24 is less than an internal diameter of the barrel 12. Therefore, the bolt 24 and the tube 26 may be slidingly received within the barrel 12 of the firearm 10 without rubbing against the barrel 12. The diameters of the tube 26 and of the head 24*a* may be less than that of the bullet 14 to avoid the bolt 24 and the tube 26 from contacting the barrel 12. The diameter of the head 24*a* of the bolt 24 may be greater than that of the aperture 14*a* defined through the bullet 14.

Still referring to FIGS. 4-5, the compressing device 100 further includes a biasing member 30, depicted as a spring in the present embodiment. The spring may be a coil spring. Any suitable biasing member may be used. The biasing member 30 is in engagement with both of the bolt 24 and the tube 26 for biasing the head 24*a* of the bolt 24 toward the tube 26. It is understood that, alternatively, the biasing member may be a linear actuator, such as a solenoid, a hydraulic actuator, a riveting clamp, and so on, without departing from the scope of the present disclosure.

In the depicted embodiment, the biasing member 30 is located axially between a first plate 32 and a second plate 34. An elongated nut, also referred to as a coupling nut, 36 is located between the first plate 32 and the second plate 34 and is surrounded by the biasing member 30. In other words, the biasing member 30 and the elongated nut 36 are concentric with the central axis A. A spacer 38 may be located between the first plate 32 and the second plate 34. In the embodiment shown, the spacer 38 is in abutment against the biasing member 30 and the second plate 34. The elongated nut 36 has internal threads 36*a* that are threadingly engaged by external threads 24*c* of the shank 24*b* of the bolt 24. It is understood that the spacer 38 may be omitted without departing from the scope of the present disclosure.

The tube 26 has a first end 26*a* in engagement with the bullet 14 and a second opposite end 26*b* in engagement with the first plate 32. It will be appreciated that, in an alternate embodiment, the tube 26 and the first plate 32 may be a single piece. In the depicted embodiment, a handle-bolt 40 is threadingly engaged to the elongated nut 36 at an opposite end thereof. The handle-bolt 40 defines an abutment face 40*a* in abutment against the second plate 34. It will be appreciated that the elongated nut 36 may be replaced by any suitable variable-length member able to decrease the effective length L of the shank 24*b* of the bolt 24. The effective length L may correspond to a length of a portion of the shank 24*b* that protrudes beyond the first plate 32.

Rotating the elongated nut 36 relative to the bolt 24 decreases an effective length L (FIG. 2) of the bolt 24 and decreases an axial distance between the first plate 32 and the second plate 34 thereby mechanically compressing the biasing member 30. Alternatively, or in combination, the handle-bolt 40 may be rotated relative to the elongated nut 36 to increase a compression force on the biasing member 30. In the embodiment shown, the compression of the biasing member 30 between the first plate 32 and the second plate 34 increases a tension force in the bolt 24, elongated nut 36, and handle-bolt 40. In other words, in use, the bolt 24, the elongated nut 36, and the handle-bolt 40 are subjected to a force in tension whereas the tube 26, the first plate 32 and the second plate 34, the biasing member 30, and the bullet 14 are subjected to a force in compression. A value of the compression force exerted by the biasing member 30 on the bullet 14 may be tuned by selecting the effective length L of the bolt 24, which affects a length of the biasing member 30 and, hence, of a reaction force said biasing member 30 exerts on the bullet 14.

In the depicted embodiment, a sacrificial sleeve 42, which may be made of plastic, is disposed around the shank 24*b* of the bolt 24 and axially between the bullet 14 and the tube 26. The sacrificial sleeve 42 may include a tube extending circumferentially around the central axis A and around the shank 24*b* and defining a longitudinal slot 42*a* that may extend along an entire length of the sacrificial sleeve 42. The sacrificial sleeve 42 may be designed such that it breaks upon the sacrificial sleeve 42 exiting the barrel 12 of the firearm 10. The sacrificial sleeve 42 may act as a pressure reliever to abruptly decrease the compression force exerted by the biasing member 30 on the bullet 14 before the bullet 14 exits the barrel 12. In some cases, said compressing force may be such that, without the barrel 12 to limit radial deformation of the bullet 14, it may crush the bullet 14 rendering any analysis of the marks imparted thereon impossible. Other means to relieve pressure are contemplated without departing from the scope of the present disclosure. Hence, the sacrificial sleeve 42 may be omitted. The compressing device 100 may includes means for disengaging the biasing member 30 from the bullet 14 when the bullet 14 is about to exit the barrel 12 to relieve the compressing force.

It has been observed that groove marks imparted on the bullet 14 may present some distortion proximate a base of the bullet 14. The base of the bullet 14 is the last part of the bullet 14 that is in contact with the barrel 12 (FIG. 1) of the firearm 10 (FIG. 1). Torsion may cause plastic deformation of the base of the bullet 14 after traveling through the barrel 12. This distortion may not be present on bullets 14 that have been fired by the firearm 10 because of their high rotational speed and rotational inertia as they are leaving the barrel 12.

At the last point of contact with the barrel 12 (e.g. grooves of the barrel 12), there may not be enough material to grip onto the bullet 14 to force the bullet to spin. In other words, there may not be enough friction force between the grooves of the barrel 12 and the bullet 14 to impart rotation to the bullet 14 in relation to the barrel 12 when the bullet 14 reaches the end of the barrel 12. Hence, it may take less energy to make a torsional plastic deformation on the surface of the bullet base than to fight the inertia of the bullet and of the compressing device for spinning. This may result in the aforementioned distortion.

In the embodiment shown, the compressing device 100 includes a guiding member 44 that is disposed between the bullet 14 and the head 24*a* of the bolt 24. The guiding member 44 may be in direct contact against the base of the bullet 14. The guiding member 44 is in abutment against the head 24*a* of the bolt 24 such that a pulling force exerted on the handle-bolt 40 is transferred to the guiding member 44 and to the bullet 14. It will be appreciated that, in some embodiments, this guiding member 44 may be omitted.

In the embodiment shown, the guiding member 44 is an annular cylinder, which may be made of copper. An inner diameter of the guiding member 44 is selected to accept the shank 24*b* of the bolt 24. An outer diameter of the guiding member 44 is selected such that a contact is created between the guiding member 44 and the barrel 12 of the firearm 10. A material of the guiding member 44 is chosen to avoid creating marks on the barrel 12. In other words, a hardness of the material of the guiding member 44 is less than a hardness of the barrel 12 of the firearm 10.

The guiding member 44 is used to guide the bullet 14 as it is leaving the barrel 12. That is, the bullet 14 may be kept concentric in relation to the barrel 12 because of the guiding member 44 that remains in the barrel 12 once the bullet 14 has exited the barrel 12. A length of the guiding member 44 in an axial direction relative to the central axis A of the compressing device 100 is selected to ensure that no lateral movement of the compressing device 100 in relation to the barrel 12 is possible until the bullet 14 is completely out of the barrel 12. The guiding member 44 may allow to avoid the distortion phenomenon discussed above. A length of the guiding member 44 may be at least about half that of the bullet 14.

In a particular embodiment, a minimal length of the guiding member 44 is selected to minimize the lateral movement of the compressing device 100. The lateral forces may be minimized when the barrel 12 points in a direction parallel to the gravity and when the compressing device 100 is pulled by its center aligned with the central axis A. The lateral forces are minimized for reducing the length of the guiding member 44. The minimum length of the guiding member 44 may be from about 2 mm for a bullet having a diameter of about 9 mm. A length of the guiding member 44 may be from about 15% to 25% of a diameter of the bullet 14.

The biasing member 30 compresses both of the bullet 14 and the guiding member 44. The compression force exerted by the biasing member 30 radially deforms the bullet 14 and the guiding member 44 such that outer faces of both of the bullet 14 and the guiding member 44 become biased against the barrel 12 and inner faces of both of the bullet 14 and the guiding member 44 become biased against the shank 24*b* of the bolt 24.

Moreover, as the bullet 14 is moving within the barrel 12, the grooves of the barrel 12 cause the bullet 14 to rotate about the central axis A. As the bullet 14 starts to exit the barrel 12, less and less surface of the bullet 14 is in contact with the barrel 12. Therefore, less and less friction force is provided by the barrel 12 on the bullet 14 to rotate the bullet 14 about the central axis A. This contributes to the distortion phenomenon disclosed above. In the embodiment shown, the guiding member 44 is in contact with the barrel 12 and the grooves of the barrel 12 impart rotation to the guiding member 44 about the central axis A. The guiding member 44 and the bullet 14 are both frictionally engaged to the shank 24*b* of the bolt 24 because they were deformed radially outwardly by the biasing member 30 that compresses the guiding member 44 against the bullet 14. As the bullet 14 leaves the barrel 12, the guiding member 44 is still in contact against, and frictionally engaged to, the barrel 12 and is therefore still rotating about the central axis A. The guiding member 44 may therefore contribute in keeping the bullet 14 in rotation about the central axis A until the bullet 14 is totally out of the barrel 12 thanks to the frictional engagement of both the bullet 14 and the guiding member 44 against the shank 24*b* of the bolt 24 and thanks to the guiding member 44 engaged by the grooves of the barrel 12 and thus rotating about the central axis A. The guiding member 44 may therefore act as a bullet extension on which the barrel 12 will impart marks. The distortion phenomenon described above may still occur, but may occur at an end of the guiding member 44 rather than at the base of the bullet 14. Hence, the guiding member 44, by being frictionally engaged with the barrel 12, and, by being frictionally engaged with the bullet 14 via the shank 24*b* because of the deformation resulting from the compression force imparted by the biasing member 30, rotates the bullet 14 and the shank 24*b* about the central axis 11 until the bullet 14 is completely out of the barrel 12.

Markings imparted by the barrel 12 on the bullet 14 while the bullet 14 is being mechanically pulled through the barrel 12 using the compressing device 100 may correspond to markings that would be imparted on the bullet 14 had the bullet 14 been fired by the firearm 10. It may therefore be possible to simulate the firing of the bullet 14 by the firearm 10 without actually firing the firearm 10 and without compromising the accuracy of the markings imparted on the bullet 14 by the barrel 12.

Figure 6A:
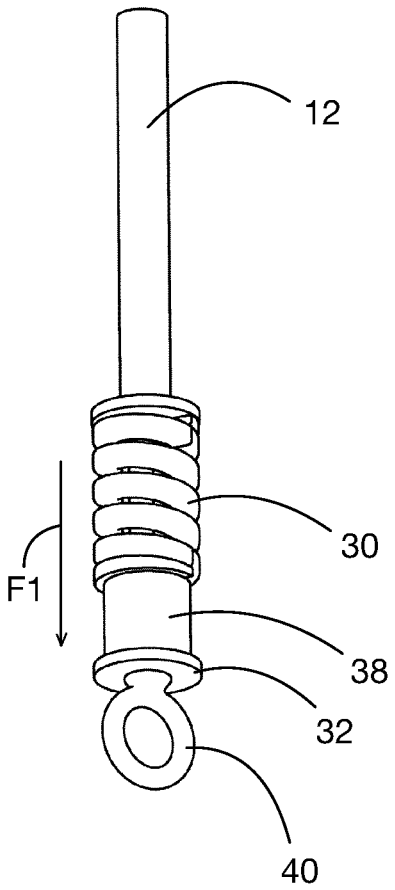
FIGS. 6A to 6C are three dimensional views of the device of FIG. 4 shown in different steps of a process of creating the marks on the bullet.
Figure 6B:
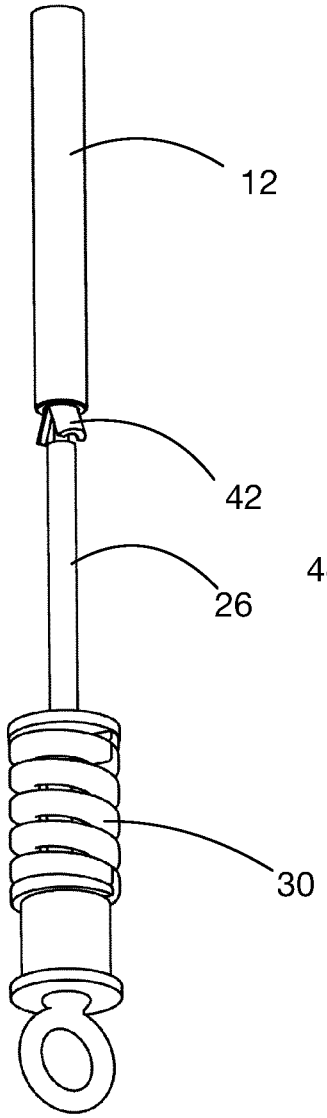
Figure 6C:
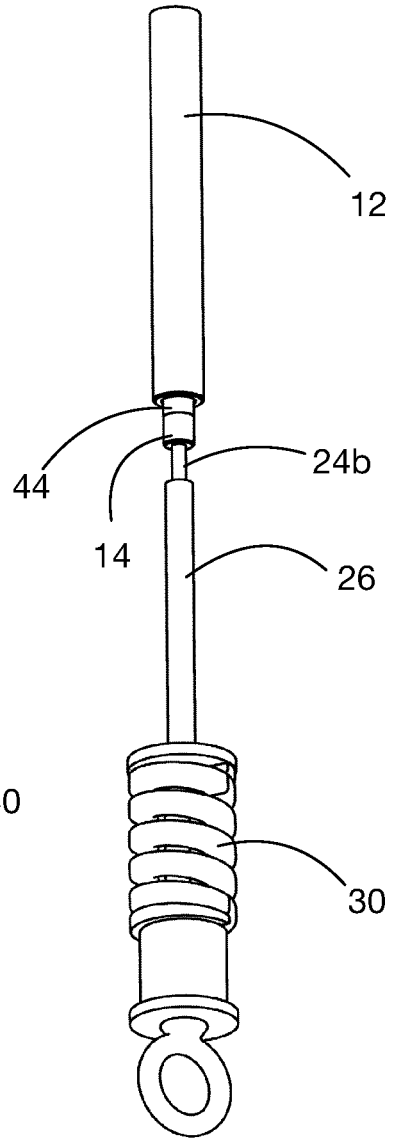

Referring now to FIGS. 6A to 6C, with continued reference to FIGS. 4-5, a process of creating the marks on the bullet 14 is described here below. The aperture 14*a* is defined through the bullet 14, the shank 24*b* of the bolt 24 may be inserted through the aperture 14*a* of the bullet 14, the tube 26 and the sacrificial sleeve 42 may be slid around the shank 24*b* of the bolt 24 and the sacrificial sleeve 42 may be abutted against the bullet 14. It may be require to truncate the bullet 14 before creating the aperture 14*a*. The bolt 24 may be threaded into the elongated nut 36. The handle-bolt 40 may be threaded into the opposite end of the elongated nut 36. A portion of the bolt 24, of the tube 26, the sacrificial sleeve 42, and the bullet 14 are slid into the barrel 12 of the firearm 10. Then, the elongated nut 36 may be rotated relative to the bolt 24 and/or the handle-bolt 40 to decrease the distance between the first plate 32 and the second plate 34 thereby decreasing the effective length L of the bolt 24, which increases a compression force on the biasing member 30, which may translate in an equivalent increase of a compression force onto the bullet 14 by the head 24*a* of the bolt 24 and the tube 26.

As shown in FIG. 6A, once the desired compression force exerted by the biasing member 30 on the barrel 12 is achieved, the bullet 14 may be moved relative to the barrel 12 along direction F1. This may be done by pushing on the head 24*a* of the bolt 24 in an axial direction relative to the central axis A and/or by pulling on the handle-bolt 40 in the axial direction to move the bullet 14 relative to the barrel 12 so that the barrel 12 may impart its marks on the bullet 14. The pulling and/or pushing action may be carried using an actuator, such as a hydraulic press, or other suitable means.

As shown in FIG. 6B, the sacrificial sleeve 42 is visible and, because it is no longer circumscribed by the barrel 12, it may buckle, break, and be ejected away from the bolt 24. In so doing, the distance between the first plate 32 and the second plate 34 may increase rapidly so is the length of the biasing member 30, and subsequently, the compression force exerted on the bullet 14 is relieved. However, because the bullet 14 has already been deformed by the compression force imparted by the biasing member 30, the bullet 14 remains frictionally engaged to the barrel 12 even if the biasing member 30 no longer compresses the bullet 14.

As shown in FIG. 6C, once the sacrificial sleeve 42 is broken away from the bolt 24, it is possible to continue pulling and/or pushing on the bullet 14 along the barrel 12 to eject the bullet 14 out of the barrel 12. As explained above, the guiding member 44 being frictionally engaged to both of the barrel 12 and the bullet 14 contributes in spinning the bullet 14 about the central axis A at least until the bullet 14 is completely out of the barrel 12. Then, the bullet 14 may be separated from the shank 24*b* of the bolt 24 and may be further processed for comparing the marks imparted by the barrel 12 on the bullet 14. As illustrated in FIG. 6C, after the sacrificial sleeve 42 is removed from the shank 24*b* of the bolt 24, a gap remains between the tube 26 and the bullet 14. Hence, there may be no more compressive force exerted by the biasing member 30 on the bullet 14 once the sacrificial sleeve 42 is removed.

For creating marks imparted by the barrel 12 of the firearm 10 on the bullet 14, the bullet 14 is inserted within the barrel 12; the bullet 14 is deformed in a radial direction relative to the central axis A; and the compressed bullet 14 is dragged in the axial direction along the barrel 12 thereby imparting marks on the bullet 14.

In the embodiment shown, inserting the bullet 14 within the barrel 12 includes disposing the bullet 14 between the first member 20 and the second member 22. Herein, compressing the bullet 14 includes decreasing the distance L1 between the first member 20 and the second member 22. Compressing the bullet 14 may include decreasing the length of the biasing member 30. A compression force exerted on the bullet 14 may be removed before the bullet 14 is removed from the barrel 12. In the depicted embodiment, an aperture 14*a* may be defined through the bullet 14 and the shank 24*b* of the bolt 24 may be inserted within the aperture 14*a*. Compressing the bullet 14 may include compressing the 30 spring by decreasing the effective length L of the shank 24*b* thereby increasing the tension force exerted on the shank 24*b* of the bolt 24. In some cases, the bullet 14 may be frozen to increase its stiffness. This may improve the quality of the markings imparted on the bullet 14 during the cold firing process.

Figure 7:
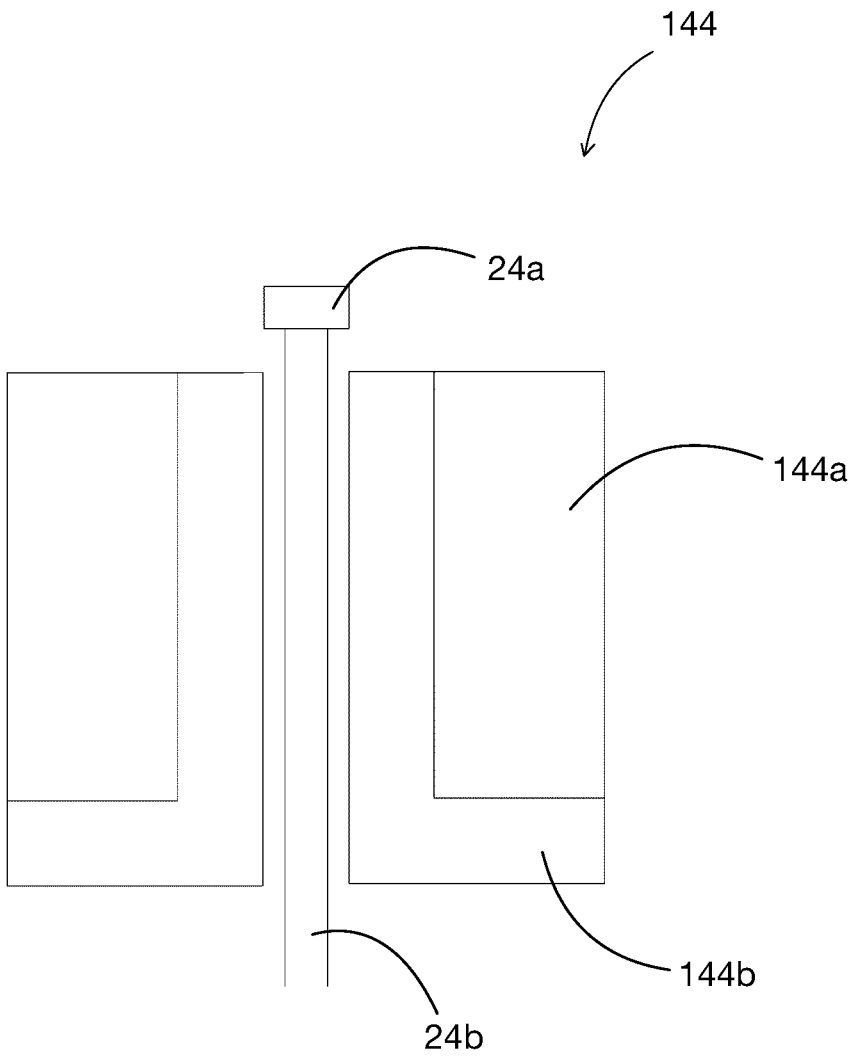
FIG. 7 is a schematic cross-sectional view of a portion of a compressing device for creating marks on a bullet in accordance with another embodiment.

Referring now to FIG. 7, an alternate embodiment of the guiding member is shown at 144. The guiding member 144 includes an outer annular cylinder 144*a*, which may be made of hard rubber other suitable materials, and a spacer 144*b*. The spacer 144*b* has a L-shape when seen in a cross-section taken on a plane containing the central axis A. In other words, the spacer 144*b* is annularly shape and defines a shoulder facing an axial direction relative to the central axis A and against which the outer annular cylinder 144*a* may abut.

The spacer 144*b* may be made of steel or other suitable materials. That is, a material of the spacer 144*b* is stiffer than that of the outer annular cylinder 144*a* to limit axial deformation of the outer annular cylinder 144*a* when compressed by the biasing member 30. The outer annular cylinder 144*a*, by being made of hard rubber, may be engaged by the grooves of the barrel 12 such that the barrel 12 imparts a rotation to the guiding member 144 without damaging the barrel 12. The outer annular cylinder 144*a* may be frictionally engaged to the spacer 144*b* to transmit a rotational motion from the outer annular cylinder 144*a* to the spacer 144*b* as explained above. The bullet 14 is in abutment against the spacer 144*b* and is frictionally engaged to the spacer 144*b* by the compression force exerted on these two components by the biasing member 30.

In use, the bullet 14 is pushed through the barrel 12 and the grooves of the barrel 12 impart rotation of the outer annular cylinder 144*a*. The outer annular cylinder 144*a* rotates the spacer 144*b* and the spacer 144*b* rotates the bullet 14 to at least partially alleviate the distortion phenomenon discussed above. The guiding member 144 may further helps in maintaining the bullet 14 concentric in relation to the barrel 12 until the bullet 14 is totally out of the barrel 12.

Figure 8:
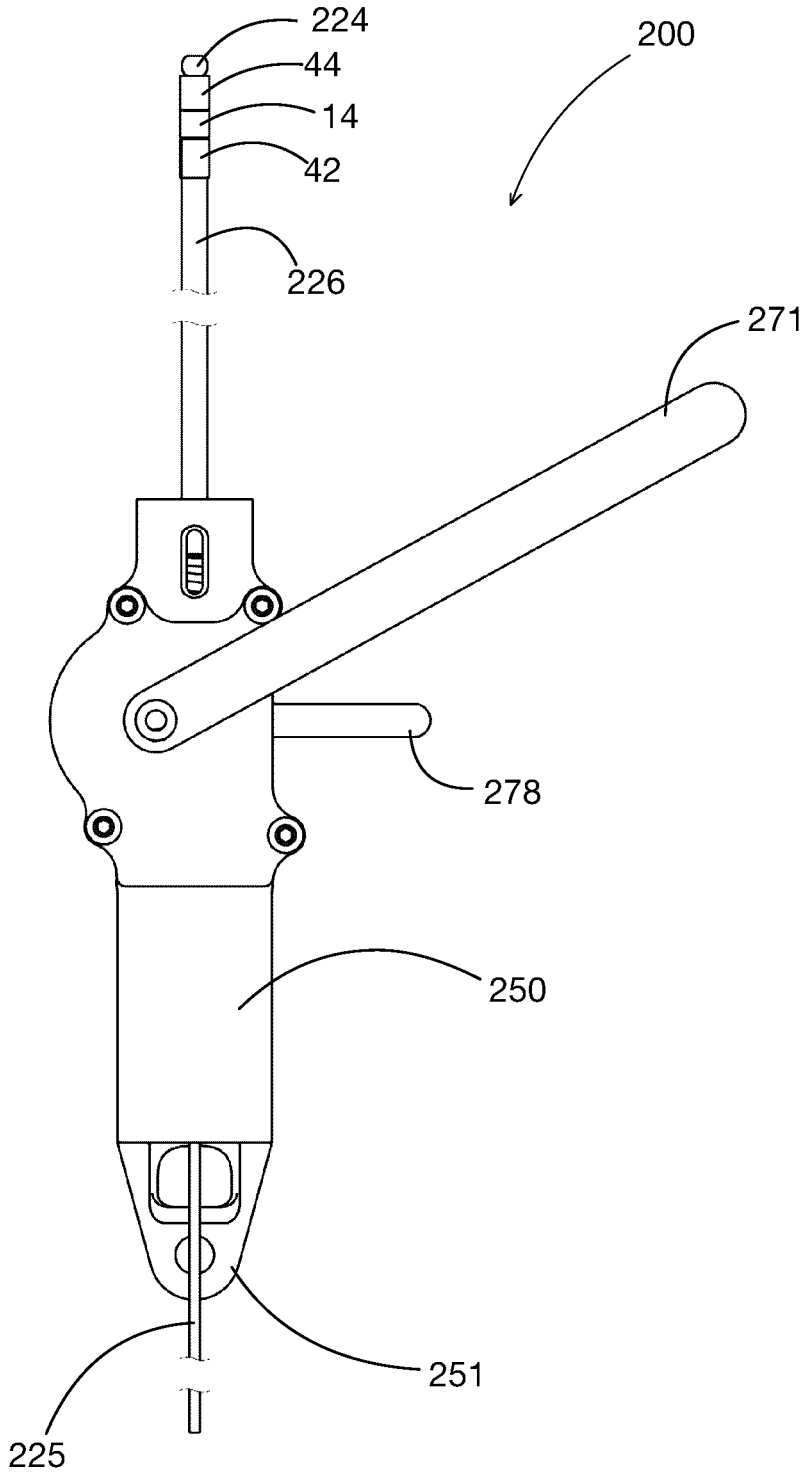
FIG. 8 is a front view of a compressing device in accordance with yet another embodiment to be used with the cold firing apparatus of FIG. 2.
Figure 9:
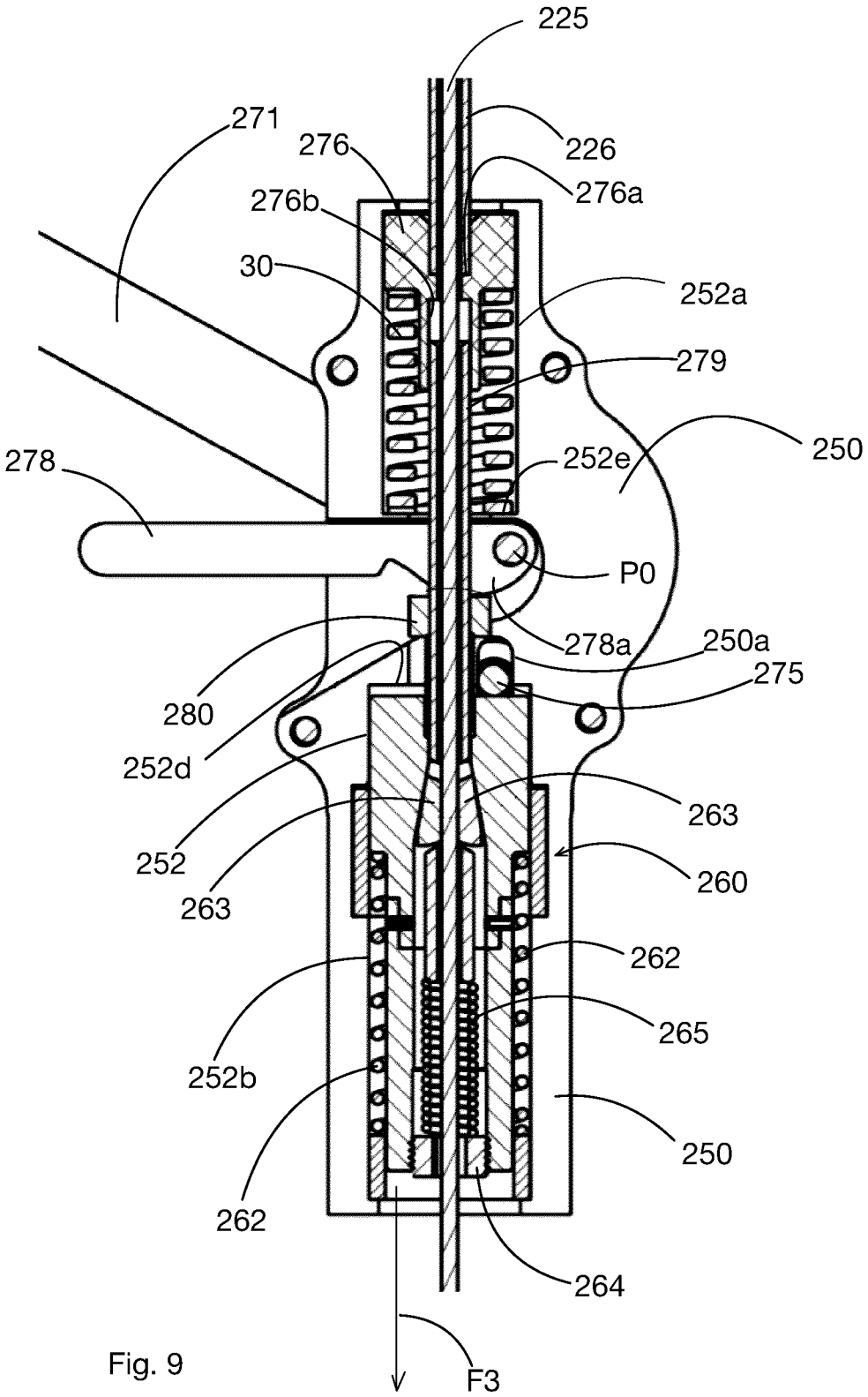
FIG. 9 is a cutaway view of the compressing device of FIG. 8.
Figure 10:
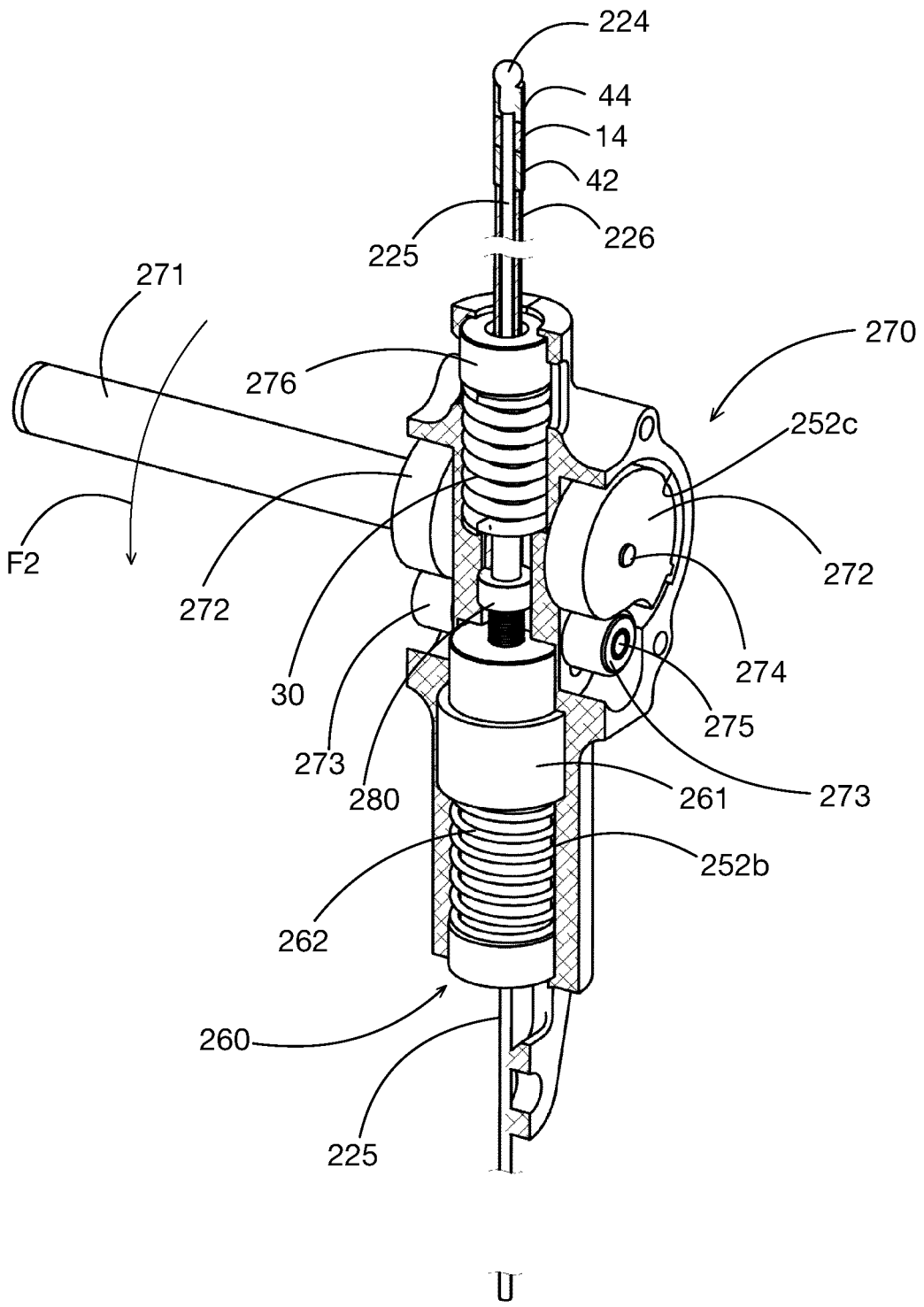
FIG. 10 is a three dimensional cutaway view of the compressing device of FIG. 8.

Referring now to FIGS. 8-10, the compressing device 200 used with the cold firing apparatus 1 of FIG. 2 is described in detail. The compressing device 200 includes a first member and a second member used for compressing the bullet 14. In the embodiment shown, the first member corresponds to a bulge 224 located at an end of a cable 225, and the second member corresponds to a tube 226. The bullet 14 is compressed between the bulge 224 and the tube 226. As explained above, the bullet 14 is compressed by the bulge 224 and the tube 226 and between the sacrificial sleeve 42 and the guiding member 44. The compressing device 200 includes a housing 250 that includes one or more flanges 251 at a bottom of the housing 250. The one or more flanges 251 are engageable by the pulling device 6 (e.g., winch, linear actuator) for pulling the compressing device 200 thereby pulling the bullet 14 through the barrel 12 of the firearm 10. The housing 250 is shown where as having a plurality of interconnected sidewalls, but any other suitable configurations are contemplated.

Using a cable 225 instead of the bolt 24 (FIG. 4) may allow to insert the cable 225, the bullet 14, the sacrificial sleeve 42, and the guiding member 44 into the barrel 12 of the firearm 10 without having to dismantle the firearm 10. More specifically, in some firearms, a location via which a bullet may be inserted is located on a side of the barrel 12 such that the bullet 14 is inserted along a radial direction relative to the central axis A of the barrel 12 into the barrel 12. The cable 225, by being flexible, may allow the insertion of the bullet 14 via this location without having to separate the barrel 12 from a remainder of the firearm 10 to insert the bullet 14 coaxially relative to the barrel 12.

Referring more particularly to FIGS. 9-10, the housing 250 has an inner cavity 252 that receives a biasing member 30 (e.g., spring) for exerting a compression force on the bullet 14, a cable holding device 260 for locking the cable 225 while the compression force is applied on the bullet 14, and a tensioning device 270 for increasing a tension into the cable 225 for compressing the bullet 14. The inner cavity 252 has a first section 252*a* sized to accept the biasing member 30, a second section 252*b* to accept the cable holding device 260, and a third section 252*c* between the first section 252*a* and the second section 252*b* and sized for receiving components of the tensioning device 270. In the embodiment shown, the first section 252*a*, the second section 252*b*, and the third section 252*c* communicate with one another.

In the embodiment shown, the cable holding device 260 includes a cylindrical member 261 received within the second section 252*b* of the inner cavity 252 of the housing 250. The cylindrical member 261 is biased toward a first shoulder 252*d* of the housing 250 via a spring 262 that is located radially between the cylindrical member 261 and a wall of the housing 250. The first shoulder 252*d* is located between the second section 252*b* and the third section 252*c* of the inner cavity 252. The cylindrical member 261 may define a shoulder against which the spring 262 abuts. The cylindrical member 261 defines an internal passage sized to receive the cable 225. A portion of the internal passage has a frustoconical shape. Two jaws 263, although more than two jaws 263 may be used, are received in the internal passage at the portion having the frustoconical shape. Each of the two jaws 263 has an outer face abutting against the cylindrical member 261 and an inner face defining teeth for engaging the cable 225 as explained below. A spring 265 is received into the internal passage of the cylindrical member 261 and biases the two jaws 263 against the frustoconical portion of the cylindrical member 261. A plug 264 may be secured at an end of the cylindrical member 261 and may be received into the internal passage of the cylindrical member 261. The plug 264 may define an aperture for receiving the cable 225. The spring 265 is therefore located between the plug 264 and the two jaws 263.

In use, when the cable 225 is inserted into the internal passage of the cylindrical member 261, the two jaws 263 are pushed against the spring 265 and slide against the frustoconical portion to extend away from one another thereby increasing a space between them to allow the cable 225 to be adjusted in length as required in function of the type of firearm being analysed. Once the cable 225 is at its desired location, the spring 265 biases the two jaws 263 against the frustoconical portion thereby pushing them toward one another until their teeth engage the cable 225. At which point, a pulling force exerted on the cable 225 increases a force between the teeth and the cable 225 thereby firmly holding the cable 225 into the cylindrical member 261.

It will be appreciated that any other suitable means may be used for holding the cable 225. For instance, the cable holding device 260 may include clamps, jaws, levers, machine taper, and so on. In a particular embodiment, the cable 225 may be received into an annular cylinder and a screw may be threadingly engaged to an aperture defined radially through the annular cylinder until a tip of the screw engages the cable 225 for locking the cable 225 to the annular cylinder. Alternatively, a threaded insert may be secured to an end of the cable 225 and a tensioning force may be applied using the principles described above with reference to FIGS. 4-5.

Once the cable 225 is firmly engaged to the cable holding device 260, tension may be imparted to the cable 225 using the tensioning device 270 described below. Referring to FIGS. 9-10, the tensioning device 270 includes a lever 271 engaged to a cam 272 rotatably received in the third section 252*c* of the inner cavity 252 of the housing 250. The cam 272 is rotatable relative to the housing 250. A cam follower 273 is in abutment against the cam 272 and used for pushing the cylindrical member 261 of the cable holding device 260. The cam 272 is secured for rotation with a shaft 274; the shaft 274 being rollingly engaged to the housing 250. As shown more clearly in FIG. 10, the cam 272 includes two cams each disposed proximate a respective one of opposed ends of the shaft 274, and the cam follower 273 includes two cam followers 273 secured to one another via a follower shaft 275. Each of the two cam followers 273 is in abutment against a respective one of the two cams 272. The follower shaft 275 extends through a slot 250*a* that is elongated to allow movements of the follower shaft 275 relative to the central axis A. The follower shaft 275 is in abutment against the cylindrical section 261 to push the cylindrical section 261 along the central axis A upon rotation of the lever 271 and the cam 272.

When it is required to exert tension in the cable 225, the lever 271 is rotated in a direction F2 thereby rotating the cam 272. The cam 272 then pushes against the cam follower 273, thanks to its off-centered rotation about the shaft 274, and the follower shaft 275 connecting the two cam followers 273 pushes against the cylindrical member 261 of the cable holding device 260. Movements of the cylindrical member 261 of the cable holding device 260 along direction F3 increase a tension in the cable 225. A notch may be defined by the cam 272 for accepting the cam follower 273 when the biasing member 30 is in its compressed state for maintaining the cam 272 in a compressed position shown and for keeping the biasing member 30 in its compressed state without having to continuously hold the lever 271. Alternatively, a locking device may be used to lock the lever 271 in a position corresponding to the compressed state of the biasing member 30. Any other means for locking the compressing device 200 in the compressed state of the biasing member 30 are contemplated without departing from the scope of the present disclosure.

Referring back to FIG. 9, in the embodiment shown, the tensioning device 270 includes a pusher 276 and a guide 279. The pusher 276 defines a first shoulder 276*a* against which the tube 226 abuts. The first shoulder 276*a* may be recessed in a recess; the recess sized to accept the tube 226. The guide 279 is received within a bore 276*b* defined by the pusher 276. The guide 279 is slidably movable within the bore 276*b* of the pusher 276. This allows the movement of a release lever 278 to move the guide 279 toward the jaws 263 (FIG. 10) without having to also move the pusher 276 and, thus, without having to compress the biasing member 30. The pusher 276 and the guide 279 define a central aperture sized for receiving the cable 225. An outer diameter of the pusher 276 is selected to define a sliding engagement of the pusher 276 into the first section 252*a* of the inner cavity 252. A circ-clip or any suitable means may be used to lock the pusher 276 into the inner cavity 252 of the housing 250 once the pusher 276 has been inserted therein. The biasing member 30 extends around the guide 279 and is located between the pusher 276 and a second shoulder 252*e* of the housing 250; the second shoulder 252*e* located at the first section 252*a* of the inner cavity 252 and between the first and third sections 252*a*, 252*c* of the inner cavity 252.

The pusher 276 may be secured to the tube 226 such that axial movements of the tube 226 relative to the housing 250 translates into axial movements of the pusher 276 for compressing the biasing member 30. An end of the guide 279 is slidingly received into the internal passage of the cylindrical member 261 of the cable holding device 260. This may help in guiding the cable 225 between the two jaws 263 of the cable holding device 260. Other configurations are contemplated.

In use, when the lever 271 is rotated in the direction F2 in FIG. 10, the cam 272 rotates and pushes against the cam follower 273 to move the cylindrical member 261 and the cable 225 secured thereto, in a downward direction to pull on the cable 225. This pulling motion on the cable 225 pushes on the bullet 14 via the bulge 224, which pushes on the tube 226. The tube 226 hence pushes on the pusher-guide 276 thereby compressing the biasing member 30. The biasing member 30 exerts a reaction force against the bullet 14 via the tube 226. The bullet 14 is then compressed between the bulge 224 and the tube 226 by a force that is function of a length variation of the biasing member 30 and of a spring constant of the biasing member 30. It will be understood that the lever 271 is rotated only once the bullet 14 is inserted into the barrel 12 of the firearm 10. Once the bullet 14 is adequately compressed, the pulling device 6 (FIG. 2), or any other suitable pulling means, may be actuated to pull the compressing device 200, and the bullet 14 secured thereto, along the barrel 12 of the firearm 10 for creating marks on the bullet 14 for further analysis by law enforcement officers.

It will be understood that any other suitable tensioning device may be used without departing from the scope of the present disclosure. For instance, a rack and pinion system in which the cable is secured to a rack gear meshed with a pinion gear; the pinion gear rotated by a motor or by the lever 271; a gear and ratchet system in which the ratchet rotates a gear and in which the cable 225 is spooled around the gear; a cables and pulley in which a cable is pulled and in which a pulley system increases a force exerted on the cable 225, a worm gear system in which a worm gear, which may be engaged by a motor or the lever 271, is meshed with a worm wheel around which the cable 225 is spooled, a lever system in which a lever is pivotally engaged to the housing 250 and in which the cable 225 is attached to the lever between a fulcrum and an end of the lever, and so on may be used to exert tension on the cable 225 without departing from the scope of the present disclosure. Any suitable actuators may alternatively be used for tensioning the cable 225.

Referring more particularly to FIG. 9, once the bullet 14 exits the barrel 12 of the firearm 10, tension in the cable 225 may be released. To do so, the lever 271 may be rotated to remove the tension exerted in the cable 225 by the biasing member 30. Then, a release lever 278 may be engaged by a user to disengage the cable 225 from the cable holding device 260. The release lever 278 includes a cam section 278*a* that abuts a collar 280 that is secured on the guide 279. The release lever 278 is rotatable about a pivot P0 to bias the cam section 278*a* against the collar 280 thereby moving the guide 279 downwardly in the direction F3 against the jaws 263 to free the cable 225. This pushes the jaws 263 away from the frustoconical portion and away from one another thereby allowing their teeth to disengage the cable 225. The cable 225 may then be removed from the compressing device 200 to free the bullet 14. In the current embodiment, the pivot P0 is common to both of the release lever 278 and the lever 271, but other configurations are contemplated.

In an alternate embodiment, the release lever 278 may extend through the housing 250 and at least partially surrounds the guide 276. The release lever may define an aperture through which the guide 276 extends. Alternatively, the release lever may include two prongs each disposed on opposite sides of the guide 276. In this alternate embodiment, the guide 276 defines a flange engageable by the release lever. That is, when a portion of the release lever that is located outside the housing 250 is pushed, a portion of the release lever located inside the housing 250 moves and pushes against the flange of the guide. This may result in the end of the guide pushing against the two jaws 263 to disengage their teeth from the cable 225 thereby freeing the cable from the cable holding device 260. The cable 225 may then be removed from the compressing device 200 to free the bullet 14.

Figure 11:
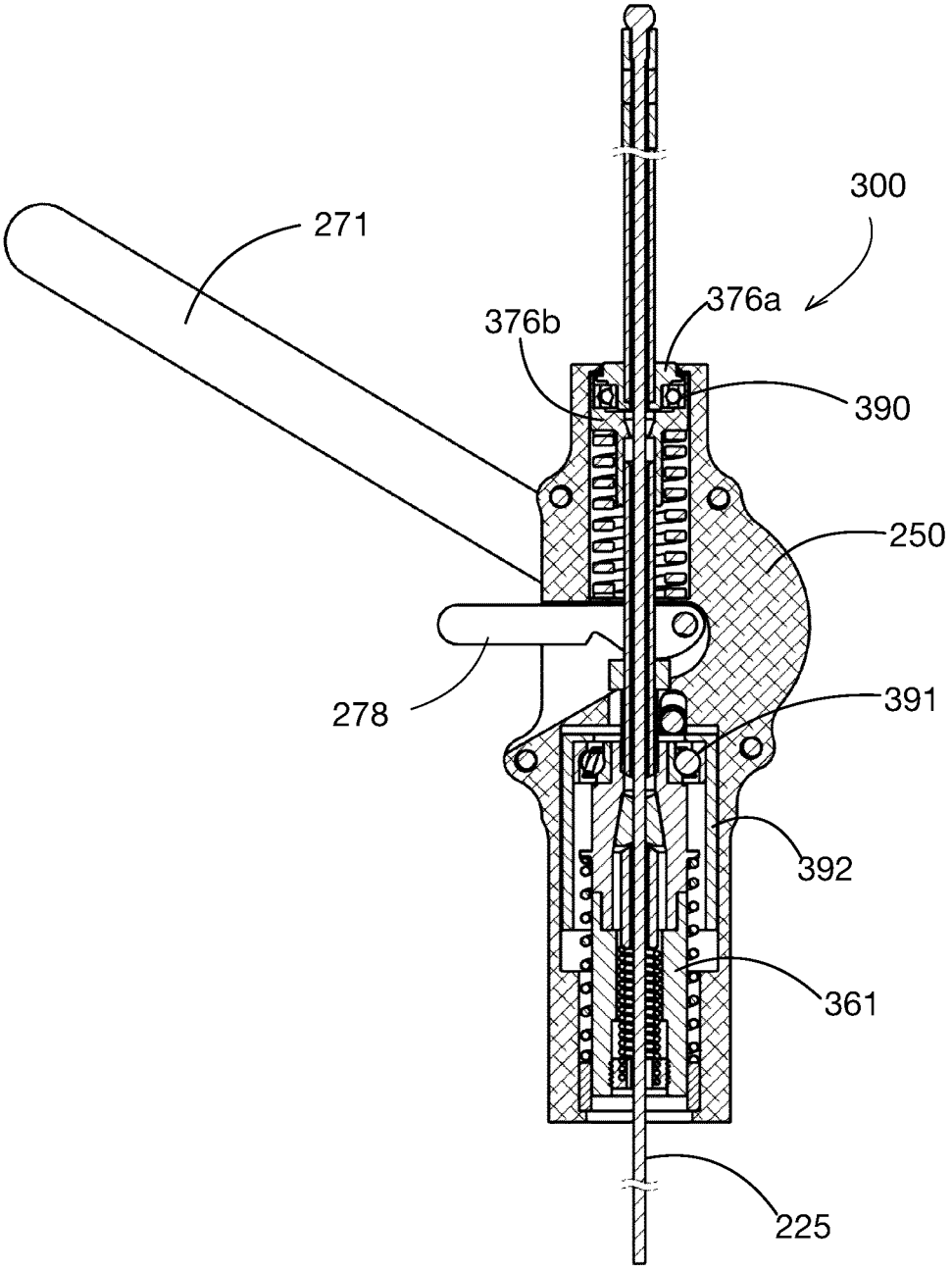
FIG. 11 is a front cutaway view of a compressing device in accordance with yet another embodiment to be used with the cold firing apparatus of FIG. 2

Referring to FIG. 11, another embodiment of a compressing device is shown at 300. For the sake of conciseness, only elements that differ from the compressing device 200 described above with reference to FIGS. 8-10 are described below.

The compressing device 300 includes a first thrust bearing 390 and a second thrust bearing 391 to allow rotation of the cable 225 and bullet 14 relative to the housing 250. In the embodiment shown, the pusher 376 has a first pusher sections 376*a* and a second pusher section 376*b*. The first thrust bearing 390 is disposed axially between the first and second pusher sections 376*a*, 376*b* to allow rotation of the first pusher section 376*a* and of the tube 226 relative to the second pusher section 376*b* and the housing 250.

The device 300 includes a cylindrical housing 392 extending around the cylindrical member 361. The second thrust bearing 391 is disposed between an annular flange of the cylindrical housing 392 and a shoulder of the cylindrical member 361. Therefore, the cylindrical member 361 may remain non-rotatable relative to the housing 250. The second thrust bearing 391 may allow rotation of the cylindrical member 361 and the cable 225 and bullet 14 relative to the housing 250 and cylindrical housing 392.

In some cases, a pivotable connection may be provided between the compressing device 200 and the pulling device 6 (FIG. 2) to allow relative rotation of the compressing device 200 and the bullet 14 relative to the cold firing apparatus 1. Alternatively, the firearm 10 may be permitted to rotate relative to the cold firing apparatus 1 to allow the bullet 14 to rotate relative to the firearm 10.

Figure 12:
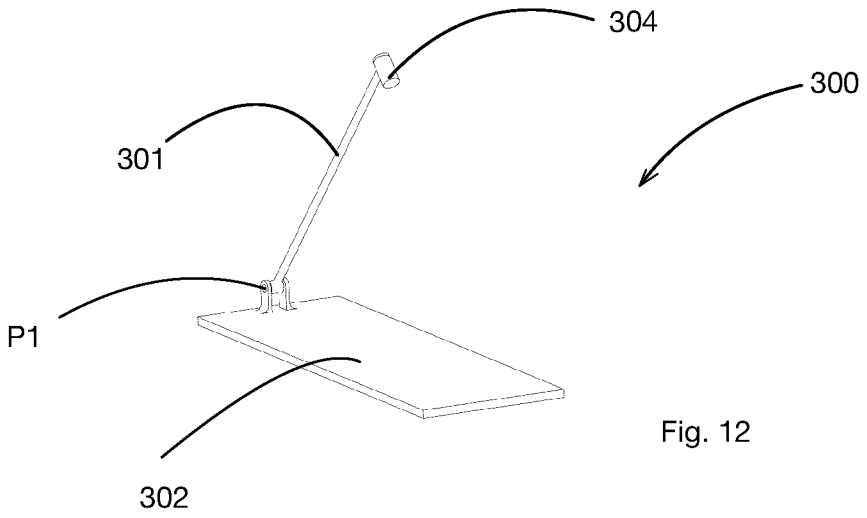
FIG. 12 is a three dimensional view of a device for compressing a bullet by deceleration shown in a first position.
Figure 13:
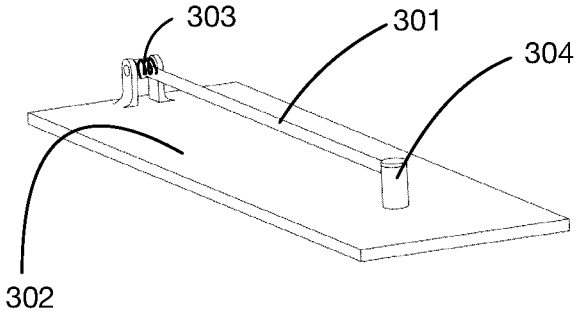
FIG. 13 is a three dimensional view of the device of FIG. 12 shown in a second position.
Figure 14:
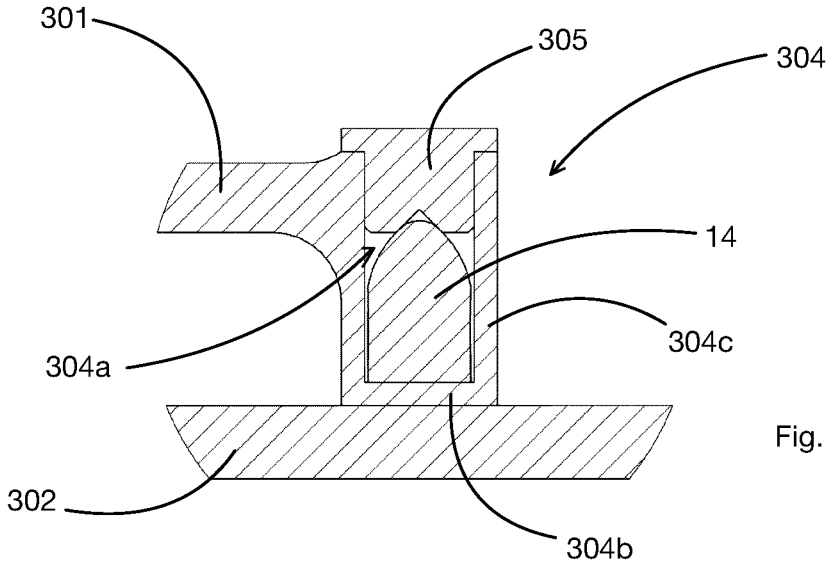
FIG. 14 is a cross-sectional view of a portion of the device of FIG. 12.

Referring to FIGS. 12-14, a device for compressing the bullet 14 is shown at 300. The device 300 uses a rapid and sudden deceleration to create a compressing force on the bullet 14. After the bullet 14 has been compressed with the device 300, the bullet 14 may be pushed or pulled through the barrel 12 to create the marks on the bullet 14.

The device 300 includes an arm 301 pivotably connected to a base 302 by an arm pivot P1. A torsional spring 303 stores potential energy relatively to an angle between the arm 301 and the base 302. The device 300 includes a bullet container 304 at a distal end of the arm 301 relative to the arm pivot P1. The bullet container 304 defines a cavity 304*a* defined by a bottom wall 304*b* and a peripheral wall 304*c* of the bullet container 304. The bullet 14 is inserted in the cavity 304*a* until it is laid against the bottom wall 304*b*. A cap or plug 305 may be engaged to an open end of the cavity 304*a* to close the cavity 304*a* and to prevent the bullet 14 from exiting the cavity 304*a* during the compressing process. The plug 305 may be frictionally engaged or may be threaded to the peripheral wall 304*c*. An inner diameter of the cavity 304*a* is selected to be larger than the bullet 14 outer diameter for allowing a plastic deformation of the bullet 14. The bullet base is oriented toward the base 302, against the bottom wall 304*b*. Friction between the base of the bullet 14 and the bottom wall 304*b* may be reduced with lubricant, PTFE or any equivalent solution.

By pivoting the arm 301 in relationship to the base 302, the torsional spring 303 is loaded and accumulates potential energy. When the arm 301 is released, the potential energy of the torsional spring 303 is transferred to the arm 301 to accelerate the arm 301 until the bottom wall 304*b* of the bullet container 304 hits the base 302. By hitting the base 302, the bullet 14 decelerates violently and is compressed under its own mass following an increasing gradient from its head to the base. This may plastically deform the bullet 14.

A material of the peripheral wall 304*c* and the bottom wall 304*b* of the bullet container 304 should be harder than a material of the bullet 14 to avoid the bullet container 304 from deforming following the impact. A constant of the torsional spring 303 and an angle of the arm 301 relative to the base 302 are selected to control the impact energy. A control handle may be fixed on the lever pivot P1 for indicating the impact energy.

The device 300 may allow to compress the bullet 14 before inserting the bullet 14 in the barrel 12 for imparting the marks on the bullet 14. Any other suitable way of accelerating and decelerating the bullet 14 to compress said bullet 14 is contemplated. For instance, the bullet 14 may be accelerated linearly with an elastic band, may be dropped from a certain height and so on. In some cases, the bullet 14 may be contained in a housing and the housing may be hit by a hard object having a predetermined speed.

Any other suitable ways of compressing the bullet 14 are contemplated. For instance, the head of the bolt or the bulge of the cable may have a frusto-conical shape such that when the cable or the bolt is pulled, the head or bulge is forced inside the aperture 14*a* (FIG. 2) defined through the bullet 14 thereby exerting a radially outward force against the bullet 14 to deform it radially outwardly until it is biased against the barrel 12. In other cases, shims may be inserted into the aperture 14*a* of the bullet 14 and moved one toward the other to increase an effective diameter to deform the bullet 14 radially outwardly. In such cases, the compressing of the bullet 14 may not require the biasing member 30 (e.g., spring 30).

As can be seen therefore, the examples described above and illustrated are intended to be exemplary only. The scope is indicated by the appended claims.

What is claimed is:

1. A bullet compressing device for creating marks imparted by a barrel of a gun on a bullet, comprising:

a first member;

a second member spaced from the first member by a gap, a dimension of the gap selected to correspond to at least a length of the bullet, the first and second members slidingly receivable within the barrel of the gun;

a biasing member in engagement with the first and second members, the biasing member having a compressed configuration in which the first and second members are biased toward one another thereby decreasing the dimension of the gap, one of the first and second members engageable by an actuator, the first and second members and the bullet received therebetween movable relative to the barrel thereby imparting marks on the bullet by the barrel upon actuation of the actuator.

2. The bullet compressing device of claim 1, wherein the first member is a head of a first bolt or a bulge located at an end of a cable, and wherein the second member is a tube disposed around a shank of the first bolt or around the cable, the gap defined between an end of the tube and the head of the first bolt or the bulge of the cable.

3. The bullet compressing device of claim 1, comprising a housing defining an inner cavity, the biasing member received into the inner cavity and engaged to the housing.

4. The bullet compressing device of claim 3, comprising a cable holding device received in the inner cavity and operable for securing the cable relative to the housing, and a tensioning device operable for imparting a tension in the cable for compressing the bullet between the bulge and the tube.

5. The bullet compressing device of claim 4, wherein the tensioning device has a cam rollingly engaged to the housing and a cam follower engaged by the cam, the cam follower engaged to the cable via the cable holding device, rotation of the cam pushing on the cam follower and pushing on the cable holding device thereby pulling on the cable and compressing the biasing member.

6. The bullet compressing device of claim 5, comprising a pusher and a guide both received in the inner cavity, the cable extending through the pusher, the pusher being in abutment against the biasing member, the guide partially received within a bore defined by the pusher, the biasing member located between the pusher and a shoulder defined by the housing, the biasing member extending around the guide.

7. The bullet compressing device of claim 6, comprising a release lever rotatable relative to the housing, the release lever having a cam portion engageable to the guide, rotation of the release lever pushes on the guide thereby pushing on jaws of the cable holding device to free the cable from the jaws.

8. The bullet compressing device of claim 1, wherein the biasing member is a spring.

9. The bullet compressing device of claim 1, wherein one of the first and second members is in engagement with the bullet via a sacrificial sleeve, the sacrificial sleeve being compressed by the biasing member and configured to break upon the sacrificial sleeve exiting the barrel to decrease a compression force exerted by the biasing member on the bullet.

10. The bullet compressing device of claim 9, comprising a guiding member, the bullet disposed between the guiding member and the sacrificial sleeve, the guiding member in contact against the barrel.

11. The bullet compressing device of claim 10, wherein the guiding member is made of a material having a hardness less than that of the barrel.

12. The bullet compressing device of claim 11, wherein the guiding member is made of copper.

13. A method of creating marks imparted by a barrel of a gun on a bullet, comprising: securing the gun to a frame of a cold-firing apparatus; inserting the bullet within the barrel; deforming the bullet in a radially outward direction relative to a central axis of the barrel by pushing on the bullet towards a muzzle of the barrel using a member engaged to the bullet, the member engaged to a pulling device of the cold-firing apparatus, the pulling device secured to the frame; and extracting the bullet in an axial direction along the barrel with the member and the pulling device thereby imparting marks on the bullet.

14. The method of claim 13, wherein the deforming of the bullet includes compressing the bullet in the axial direction before the pushing on the bullet towards the muzzle.

15. The method of claim 14, wherein the compressing of the bullet includes disposing the bullet between the member and a second member engaged to the member by a biasing member, the compressing the bullet in the axial direction includes decreasing a length of a biasing member.

16. The method of claim 13, comprising guiding the bullet with a guiding member at least until the bullet is completely out of the barrel, the guiding member located between the bullet and the member.

17. A cold firing apparatus for creating barrel marks on a bullet with a barrel of a firearm, comprising: a frame; a holding device secured to the frame and operable to hold the firearm; a member operable to push the bullet out of the barrel while the bullet is inside the barrel; and a pulling device engaged to the member and secured to the frame, the pulling device operable to pull on the member such that the member exerts a pushing force on the bullet along the barrel of the firearm and towards a muzzle of the barrel.

18. The cold firing apparatus of claim 17, comprising a compressing device including a biasing member, the member and a second member both engaged by the biasing member for biasing the member toward the second member, the member and the second member both receivable within the barrel, the bullet receivable between the member and the second member.

19. The cold firing apparatus of claim 18, wherein the compressing device has a cable holding device operable for securing the cable relative to a housing of the compressing device, and a tensioning device operable for imparting a tension in the cable for compressing the biasing member and for compressing the bullet between the member and the second member.

20. The cold firing apparatus of claim 17, comprising a plate rollingly engaged to the frame, the plate defining apertures of varying sizes to accept respective ends of barrels of varying caliber.

* * * * *